United States Patent [19]

Scholten

[11] 4,280,903

[45] Jul. 28, 1981

[54] APPARATUS FOR SEPARATING SAND FROM BOTANICAL FINES

[75] Inventor: David L. Scholten, Taylorsville, Ky.

[73] Assignee: Brown & Williamson Tobacco Corporation, Louisville, Ky.

[21] Appl. No.: 175,569

[22] Filed: Aug. 6, 1980

[51] Int. Cl.[3] ..... B03B 4/00

[52] U.S. Cl. ..... 209/469; 209/486; 209/502

[58] Field of Search ..... 209/138, 139 R, 154, 209/158, 424, 426, 466, 467, 469, 486, 502

[56] References Cited

U.S. PATENT DOCUMENTS

| | | | |
|---|---|---|---|
| Re. 29,625 | 5/1978 | Summers | 209/486 X |
| 3,610,415 | 10/1971 | Deak | 209/466 |
| 3,627,129 | 12/1971 | Hartmann et al. | 209/502 X |
| 3,842,978 | 10/1974 | Summers | 209/486 X |
| 3,904,515 | 9/1975 | MacKenzie et al. | 209/138 X |
| 4,216,080 | 8/1980 | Summers et al. | 209/486 X |

*Primary Examiner*—William A. Cuchlinski, Jr.

*Attorney, Agent, or Firm*—Charles G. Lamb; William J. Mason

[57] ABSTRACT

A mixture of botanical fines and sand is separated by a porous separating medium horizontally disposed within an enclosed chamber in which an upflowing stream of gas carries out the separation. The porous separating medium is comprised of a pair of opposed rotatively movable juxtaposed porous members with means for rotatively adjusting the porous members so as to change the flow through area in the porous separating medium. As a gas flows up through the porous separating medium, only the sand passes down through the porous medium and the gas entrains the botanical fines portion of the mixture above the porous members removing the botanical fines with the gas stream. Control of the velocity of gas up through the porous medium as well as the prevention of botanical fines from flowing with the sand down through the porous medium is determined by the adjustments of the rotatively mounted porous members.

7 Claims, 3 Drawing Figures

APPARATUS FOR SEPARATING SAND FROM BOTANICAL FINES

BACKGROUND OF THE INVENTION

1. Field of the Invention

The present invention relates to means for separating a light particulate material from a heavier particulate material in a mixture. The present invention even further relates to means for removing one material from a mixture using an apparatus having an adjustable flow through area therein in combination with an upwardly flowing gas stream to entrain the lighter particles in the upwardly moving gas stream and allow the passage of the heavier particles downwardly through the adjustable flow through area.

2. Description of the Prior Art

In the mass production of products utilizing botanical materials, such as tobacco for tobacco products, removal of other particulate materials from the botanical material generally results in a large or substantial amount of waste. In an industry such as the tobacco industry, the botanical components of a salable product is increasingly expensive and it is therefore necessary to recover as much of the tobacco as possible in a sand removal step of the process.

In the separation of botanical fines, such as tobacco from sand, the botanical material is much lighter than the sand and two methods of separating the components have been suggested and utilized. One method utilizes the different absorption characteristics of the two components in a heavy liquid medium. Techniques of this type have been somewhat limited in that there must be a subsequent separation of the desired botanical material from the medium affecting the separation. Where the medium carrying out the separation is a liquid, a further consideration must be made as to the effect of the liquid medium on the botanical material. Furthermore, this separation of the botanical material from the liquid may also present relatively complex problems.

U.S. Pat. No. 3,842,978 teaches an apparatus where botanical materials are separated from sand by their different response to a flowing air stream passing through a vibrating array of particles. The separation of the botanical material from the sand is carried out on a porous array having a flowing stream of gas passing up through the array. The separation is primarily controlled by the configuration and packing density of particles comprising the array and the velocity of gas passing therethrough. This type of device is rather complex, and is mechanically unsuited for many applications.

SUMMARY OF THE INVENTION

The present invention provides means for removing botanical fines from sand wherein the sand passes downwardly through a porous medium and a gas passes upwardly through the porous medium entraining the botanical fines as it leaves the porous medium. The present invention further provides means for changing the flow through area of a porous medium in a separating device for removing botanical fines from sand.

More particularly, the present invention provides an apparatus for separating the components of a mixture of sand and botanical fines comprising: a substantially enclosed chamber; an opposed pair of rotatively movable juxtaposed porous members horizontally disposed within the chamber; means for rotatively adjusting the porous members; means for vibrating the chamber; means for introducing the mixture into the chamber above the porous members; means for passing a moving stream of gas up through the porous members through the mixture; and, means for collecting the botanical fines downstream from the chamber, the collecting means being in flow communication with the chamber.

It is to be understood that the description of the examples of the present invention given hereinafter are not by way of limitation and various modifications within the scope of the present invention will occur to those skilled in the art upon reading the disclosure set forth hereinafter.

BRIEF DESCRIPTION OF THE DRAWINGS

Referring to the drawings.

DESCRIPTION OF THE PREFERRED EMBODIMENT

Figure 1:
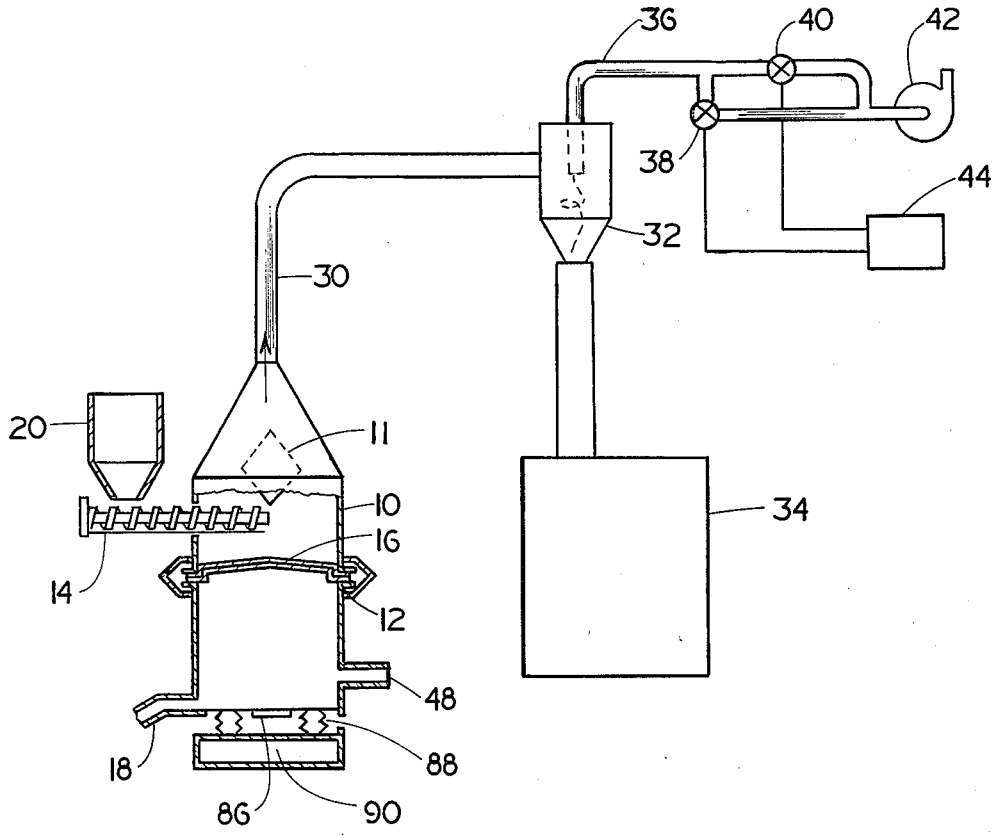
FIG. 1 is a schematic view with selected portions cut away to illustrate the specific features of the present invention in a separating device.

Referring now to FIG. 1 where the complete apparatus for separating botanical materials from sand is disclosed. As here embodied, a chamber 10 is provided to enclose a separating medium 12 onto which the mixture of botanical materials and sand is placed. A screw conveyor 14 introduces such materials to the upper surface 16 of the separating medium 12. It is realized that other feed means may also be used such as, for example, a vibrating tube in combination with a gravity pipe. As indicated by the upper arrow, gas flow through the chamber enters the bottom of the separating medium 12 and exits at the top of chamber 10. Sand in the mixture exits the bottom of the separating medium 12 out through spout 18.

The mixture of sand and botanical material is introduced to the screw conveyor 14 by means of the hopper 20. The botanical material entrained in the gas flow exiting the chamber 10 passes through the conduit 30 into means for separating the botanical material from the air stream, here embodied as a cyclone separator 32. The botanicals are then retained in container 34 with the air stream further passing through conduit 36 to means for controlling the air through the device. An elutriation cone 11 may also be incorporated in the chamber 10 to assist in the control of the gas flow containing botanicals therein exiting from the separating chamber.

As here embodied, the means for controlling the air flow includes two valves 38 and 40 with an associated pump 42. Control means 44 interacting with the valves 38 and 40 control the air flow to the pump 42. The control means may be disposed to provide constant or variable air flow through the device with constant air flow being preferred. As here embodied and best depicted in FIG. 1, the chamber 10 is cylindrical and is in flow communication with means for inducing gas flow therethrough. The chamber 10 is essentially gas-tight with the exception of the inlet 48 into which gas is drawn through the chamber 10 into the conduit 30. In order to maintain the air-tight feature of the chamber, the means for introducing the mixture to the chamber should be sealed. As here embodied, the screw feed 14 passing through one sidewall of the chamber 10 would preferrably have sealing means preventing significant gas flow around and through the screw feeder 14 into the chamber 10. Likewise, when operating, the level of sand and tobacco mixture should be maintained in hopper 20 to prevent shunting of air flow through screw conveyor 14.

Figure 2:
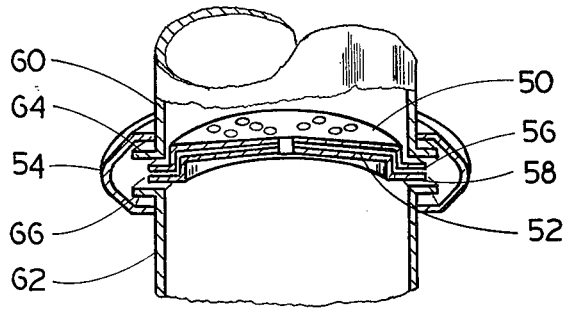
FIG. 2 is a partial cross-section of one preferred embodiment of the present invention; and, FIG. 3 is an exploded view of the embodiment of FIG. 2.
Figure 3:
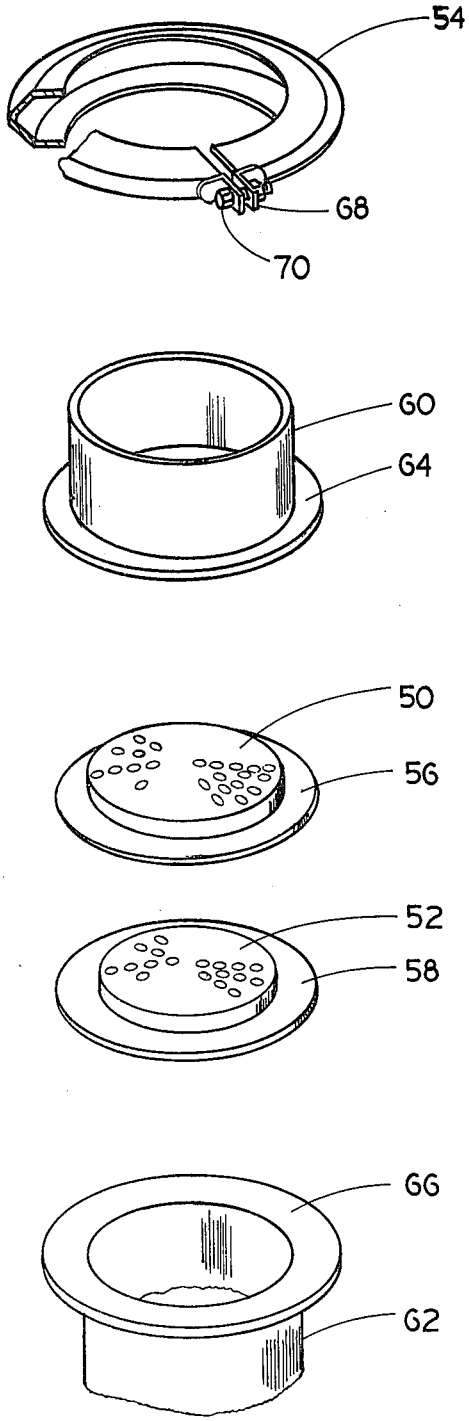

In accordance with the invention, an opposed pair of rotatively movable juxtaposed porous members 50 and 52 are horizontally disposed within the chamber 10. As shown in FIGS. 2 and 3, the porous members 50 and 52 include a plurality of apertures therein extending radially from the center of each of the members. The porous members 50 and 52 are also provided with peripheral flange portions 56 and 58, respectively.

The chamber 10 is further provided with an upper cylindrical support portion 60 and a lower cylindrical support portion 62. The cylindrical support portions 60 and 62 are provided with peripherally disposed flanges 64 and 66, respectively, at their terminal ends.

In accordance with the invention, the porous members 50 and 52 are held in place by a ring clamp 54 which engages with the flanges 64 and 66 with the flanges 56 and 58 of the porous members 50 and 52 being sandwiched therebetween. The ring clamp 54 which engages the flanges 64 and 66 is provided with a threaded fastener 68 fixed to the member 54 with an associated threaded nut 70. The engagement nut 70 on the fastener 68 changes the circumferential length of the ring clamp 54 and hence the depth of engagement of the flanges encompassed therein. In the adjustment of the flow through area through the porous members 50 and 52 the loosening of the nut 70 to increase the length of the circumferential ring member 54 and therewith loosening the hold on the flanges 64 and 66 enables the porous members 50 and 52 to be adjusted in relation to each other. The rotative movement of the porous members 50 and 52 in relation to each other changes the alignment of the apertures of the two members and thereby changes the flow through area of the separating medium 12. It is realized that one skilled in the art can devise other means of adjusting the porous members in order to change the flow through area.

As depicted in FIG. 1, the apparatus includes means for vibrating the chamber 10 and the materials flowing therethrough. As here embodied, the vibrating means 86 is depicted schematically, being fixedly attached to chamber 10. Spring connections 88 are connected at one end to chamber 10 and at the other end to support 90. The vibration of the chamber 10 assists in the separation process and also prevents the clogging of the apertures in the porous members 50 and 52.

In the operation of the present invention for the separation of the components of a mixture of sand and botanical fines in the embodiment depicted, the flow through area of the separating medium 12 is changed by loosening the ring clamp 54 and rotatively moving the porous members 50 and 52 in relation to each other thereby changing the alignment of the openings in the two porous members. The ring clamp is then tightened to securely hold the flanges 64 and 66 with the porous member flanges 56 and 58 sandwiched therebetween. The mixture of sand and botanical fines are placed within the chamber 10 by movement of material through the screw conveyor 14. The chamber 10 is vibrated by operation of the vibrating means 86 while passing a moving stream of gas up through the separating medium 12, and moving downward through the separating medium 12 while the botanical components move upward in the stream of gas. The botanical fines are thereafter collected downstream from the separating medium 12.

It is realized that in the figures, the porous members are shown as having a plurality of openings therethrough radially extending from the center of the members but it is realized that other configurations of openings may be utilized and that the openings may form other different geometric configurations such as ovals, squares and the like. The configuration of the openings to be used in the porous members is not important in the practice of the present invention so long as rotative movement of the porous members in relation to each other will change the total flow through area of the separating medium. Thus, when a change in the ratio of sand to botanical fines occurs, changing the position of the porous members in relation to each other changes the flow through area of the separating medium.

The present invention has shown particular success in separating tobacco from sand, especially when the mixture of sand and tobacco has a size in the range of from 0.15 to 0.6 millimeters with the openings in the porous members having a diameter of about 3/32" and spaced 3/16" from center to center with the gas having an estimated velocity within the separating medium of 3½ feet per second. In such an embodiment, the present invention provides a means for separating a mixture of tobacco and sand whereby the apparatus making the separation can be effectively adjusted to compensate for differences in separation behavior of different mixtures introduced to an apparatus.

It will be realized that various changes may be made to the specific embodiment shown and described without departing from the principles and spirit of the present invention.

What is claimed is:

1. An apparatus for separating the components of a mixture of sand and botanical fines comprising:

(a) a substantially enclosed chamber;

(b) an opposed pair of rotatively movable juxtaposed members horizontally disposed within said chamber;

(c) means for rotatively adjusting said porous members;

(d) means for vibrating said chamber;

(e) means for introducing said mixture into said chamber above said porous members;

(f) means for passing a moving stream of gas up through said porous members toward said mixture; and, (g) means for collecting said botanical fines downstream from said chamber, said collecting means being in flow communication with said chamber.

2. The apparatus of claim 1 wherein said means for rotatively adjusting said porous members is an adjustable ring clamp in tightening and untightening relationship with said porous members.

3. The apparatus of claim 2 wherein said chamber includes two vertical support portions disposed on opposite sides of said rotatively moveable porous members in contacting relationship with said porous members, said two portions of said chamber being provided with peripheral flanges engageable with said adjustable ring clamp.

4. The apparatus of claim 3 wherein said porous members include peripheral flange members sandwiched between said flange members of said portions of said vertical support members.

5. The apparatus of claim 1 wherein said porous members includes a plurality of openings therethrough in radially extending lines.

6. The apparatus of claim 5 wherein the diameter of the flow through openings is approximately one-half of the distance between the centers of adjacent openings.

7. The apparatus of claim 1 wherein said chamber is substantially cylindrical.

* * * * *

UNITED STATES PATENT AND TRADEMARK OFFICE

CERTIFICATE OF CORRECTION

PATENT NO. : 4,280,903

DATED : July 28, 1981

INVENTOR(S) : David L. Scholten

It is certified that error appears in the above—identified patent and that said Letters Patent is hereby corrected as shown below:

At Column 4, line 42, please insert the word "porous" after the word "movable"

Signed and Sealed this

*Fourteenth* Day of *September 1982*

[SEAL]

*Attest:*

GERALD J. MOSSINGHOFF

*Attesting Officer*

*Commissioner of Patents and Trademarks*